US005120958A

United States Patent [19]

Davis

[11] Patent Number: 5,120,958

[45] Date of Patent: Jun. 9, 1992

[54] ION STORAGE DEVICE

[75] Inventor: Stephen C. Davis, Fen Ditton, England

[73] Assignee: Kratos Analytical Limited, Manchester, England

[21] Appl. No.: 696,789

[22] Filed: May 7, 1991

[30] Foreign Application Priority Data

May 11, 1990 [GB] United Kingdom ..... 9010619

[51] Int. Cl.[5] ..... H01J 49/40

[52] U.S. Cl. ..... 250/292; 250/281; 250/282; 250/283; 250/286; 250/287

[58] Field of Search ..... 250/292, 287, 281, 282, 250/283, 286

[56] References Cited

U.S. PATENT DOCUMENTS

| | | | |
|---|---|---|---|
| 2,780,728 | 2/1957 | Langmuir | 250/286 |
| 2,790,080 | 4/1957 | Wells | 250/287 |
| 2,839,687 | 6/1958 | Wiley | 250/287 |
| 3,582,648 | 6/1971 | Anderson | 250/287 |
| 3,727,047 | 4/1973 | Janes | 250/287 |
| 3,953,732 | 4/1976 | Oron et al. | 250/287 |
| 4,072,862 | 2/1978 | Mamyrin et al. | 250/287 |

FOREIGN PATENT DOCUMENTS

| | | |
|---|---|---|
| WO83/00258 | 1/1983 | PCT Int'l Appl. . |
| 756623 | 9/1956 | United Kingdom . |
| 1302193 | 1/1973 | United Kingdom . |
| 1326279 | 8/1973 | United Kingdom . |

*Primary Examiner*—Jack I. Berman
*Assistant Examiner*—Kiet T. Nguyen
*Attorney, Agent, or Firm*—Leydig, Voit & Mayer

[57] ABSTRACT

An ion-storage device has an electrode structure for subjecting ions in a defined region along a path P to an electrostatic retarding field.

The electrostatic retarding field is in the form of an electrostatic quadrupole field. Ions enter the defined region at a position $P_1$ on the path and they exit the defined region at a position $P_2$, having travelled a distance $x_T$. Ions are subjected to the electrostatic retarding field during an initial part only of a preset time interval and the velocity of each ion during that part of the preset time interval is related linearly to its separation x from the exit position $P_2$ by the expression, $$v = k\left(\frac{q}{m}\right)^{\frac{1}{2}}\left(\frac{x}{x_T}\right)$$

where m is the mass of the ion, q is its charge and k is a constant.

Ions having the same mass-to-charge ratio (m/q) all exit the field region at the same time during the remaining part of the preset time interval.

17 Claims, 3 Drawing Sheets

ION STORAGE DEVICE

BACKGROUND OF THE INVENTION

This invention relates to an ion storage device (alternatively termed an ion buncher) and it relates particularly, though not exclusively, to an ion storage device suitable for use in a time-of-flight mass spectrometry system.

In order that a time-of-flight mass spectrometry system may have an acceptable mass resolving power, ions should enter the flight path of the spectrometer in bursts of short duration, of typically 1 to 10 nsec. If, as is often the case, the ions are extracted from a continuous ion beam the sensitivity of the spectrometer tends to be rather low since only a small proportion of the total number of ions in the beam can be utilised for analysis. This can be particularly problematical if the system is being used to analyse samples (such as biological or biochemical samples) that are only available in relatively small volumes, especially when such samples are delivered over a relatively short time scale (typically of the order of a few seconds) using a conventional inlet system, such as a liquid chromatograph.

With a view to alleviating this problem, a technique described by R. Grux et al in Int. J. Mass Spectrom Ion.Proc.93(1989) p.323–330 involves using an electron impact ion source to produce ions by electron bombardment, storing the ions for a substantial period of time in a confined space defined by a potential well, and then extracting the stored ions by applying an accelerating voltage thereto whereby to form a burst of ions of relatively short duration. In this way, it is possible to utilise a relatively high proportion of the total number of available ions.

However, this technique suffers from several drawbacks. The technique requires an electron-impact type ion source, and this may be unsuitable for many applications. The ions are subjected to space-charge effects in the confined space and this limits the number of ions that can be stored. Also, the ions tend to oscillate in the confined space and so they have a finite 'turn-around' time which limits the minimum duration of each ion burst.

SUMMARY OF THE INVENTION

According to a first aspect of the present invention, there is provided an ion storage device for storing ions moving along a path, comprising field generating means for subjecting ions to an electrostatic retarding field during an initial part only of a preset time interval, the electrostatic retarding field having a spatial variation such that ions which have the same mass-to-charge ratio and enter the ion storage device during said initial part of the preset time interval are all brought to a time focus during the remaining part of that preset time interval.

Ions entering the ion storage device are slowed down progressively by the electrostatic retarding field and are caused to bunch together. In this way, the ions are stored in the device during said initial part of the preset time interval and the stored ions all exit the device during the remaining part of that time interval.

By this means it becomes possible to extract and utilise a relatively high proportion of the ions in a continuous beam, or in a pulsed beam of relatively long duration, giving improved sensitivity. Furthermore, the stored ions do not suffer to the same extent from space-charge effects, nor are they subject to a 'turn-around' time.

The spatial variation of the electrostatic retarding field is such that the velocity of an ion during said initial part of the preset time interval is related linearly to its separation along the path from the point at which that ion is brought to said time focus.

An electrostatic retarding field satisfying this condition is an electrostatic quadrupole field, and, preferably, the field generating means for generating an electrostatic quadrupole field comprises an electrode structure having rotational symmetry about the longitudinal axis of the device.

In a preferred embodiment, the electrode structure comprises a plurality of electrodes spaced at intervals along the longitudinal axis of the ion storage device, each electrode in the plurality substantially conforming to a respective equipotential surface in the electrostatic quadrupole field and being maintained at a respective retarding voltage during the initial part of the or each said preset time interval, and having a respective aperture for enabling the ions to travel through the ion storage device.

According to another aspect of the invention, there is provided a time-of-flight mass spectrometer comprising an ion source for generating ions which move along a path, an ion storage device in accordance with said first aspect of the invention, and means for detecting the ions which exit the defined region of the ion storage device.

BRIEF DESCRIPTION OF THE DRAWINGS

Ion storage devices in accordance with the invention are now described, by way of example only, with reference to the accompanying drawings in which.

DESCRIPTION OF PREFERRED EMBODIMENTS

Figure 1:
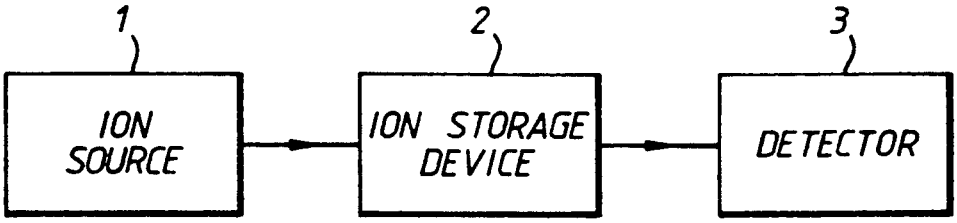
FIG. 1 illustrates diagramatically a time-of-flight mass spectrometer incorporating an ion storage device in accordance with the invention.

FIG. 1 illustrates diagramatically a time-of-flight mass spectrometer comprising an ion source 1 for generating a beam of ions, an ion storage device 2 in accordance with the invention and a detector 3 for detecting ions emergent from the ion storage device.

The ion storage device 2 comprises an electrostatic field generator.

Ions produced by the ion source 1 are constrained by suitable extraction electrodes and source optics (not shown) to travel along a path P, extending along the longitudinal X-axis, and the electrostatic field generator subjects ions occupying a defined region R of the path to an electrostatic retarding field.

Figure 2:
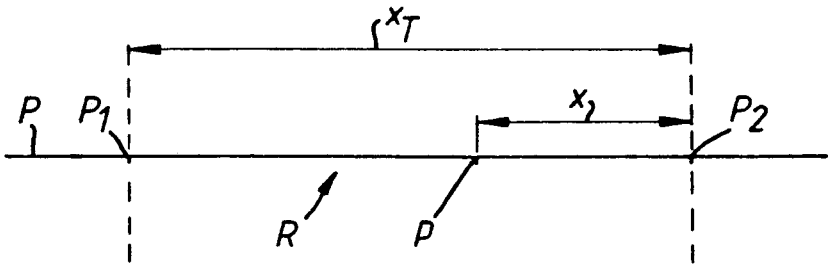
FIG. 2 illustrates a defined region in the ion storage device of FIG. 1.

As is shown schematically in FIG. 2, ions enter region R at a position $P_1$ on the path and they exit the region at a position $P_2$, having travelled a distance $x_T$ along the path.

In operation, the electrostatic field generator is energised during an initial part only of a preset time interval (referred to hereinafter as the 'ion-storage' period) and is de-energised during the remaining part of that time interval (referred to hereinafter as the 'listening' period). The electrostatic field generator may be energised and de-energised alternately, and ions which enter the defined region R during a respective ion-storage period all exit the region during the immediately succeeding listening period.

Ions entering region R are slowed down progressively by the electrostatic retarding field as they penetrate deeper into the region and so they accumulate in the region during the respective ion-storage period.

The electrostatic retarding field applied to the ions is such that the velocity v of an ion, moving along path P during a respective ion-storage period is related linearly to its separation x from the exit position $P_2$.

More specifically, the velocity v of the ion during that period can be expressed as $$v = k\left(\frac{q}{m}\right)^{\frac{1}{2}}\left(\frac{x}{x_T}\right) \quad (1)$$

where m is the mass of the ion, q is its charge, and k is a constant.

Thus, for example, if an ion enters the region R with an initial velocity $v_1$, its velocity at the mid-point ($x=\frac{1}{2}x_T$) in the region would be $\frac{1}{2}v_1$ and its velocity at the position $x=\frac{1}{4}x_T$ would be $\frac{1}{4}v_1$. Clearly, as the ion penetrates deeper into the defined region R its velocity is reduced in proportion to the distance it has travelled.

An ion entering region R during an ion-storage period continues to travel towards the ex it position $P_2$ during the subsequent listening period, after the field generator has been de-energised. As will be clear from equation 1 above, ions having the same mass-to-charge ratio will all arrive at the exit position $P_2$ at substantially the same time, regardless of their respective positions in region R at the instant the field generator is de-energised. For example, the distance from the exit position $P_2$ of an ion at the mid-position is half that of an ion at the entry position $P_1$; however, the velocity of the latter is twice that of the former. Accordingly, ions having the same mass-to-charge ratio are caused to bunch together at the exit position $P_2$, and ions having different mass-to-charge ratios will arrive at the exit position $P_2$ at different respective times, enabling them to be distinguished in terms of their different mass-to-charge ratios.

In this way, ions having the same mass-to-charge ratio are all brought to a time focus at the exit position $P_2$.

The condition set forth in equation 1 will be satisfied if the retarding voltage V at any position x along path P is given by $$V = \left\{1 - \left(\frac{x}{x_T}\right)^2\right\}V_o \quad (2)$$

where $V_o$ is the retarding voltage applied across the defined region R. If $V_o$ is equal to the accelerating voltage i.e. the voltage applied to the ion source, it will be apparent from equation 2 that the kinetic energy of an ion at a point x will be $$q\left\{V_o - \left[1 - \left(\frac{x}{x_T}\right)^2\right]V_o\right\} = qV_o\left(\frac{x}{x_T}\right)^2, \quad (3)$$

and it can be seen from equation 3 that the velocity v of the ion will be $$v = \left\{\frac{2qV_o}{m}\left(\frac{x}{x_T}\right)^2\right\}^{\frac{1}{2}} = \left(\frac{2qV_o}{m}\right)^{\frac{1}{2}}\frac{x}{x_T},$$

as required by Equation 1 above.

Alternatively, it would be possible to use a retarding voltage slightly larger or smaller than the accelerating voltage, and the effect of this is to shift the time focal point for the ions to a position respectively upstream or downstream of the position $P_2$ shown in FIG. 2, although the focussing effect would not be quite so good.

A preferred electrostatic retarding field for the ion storage device 2 is an electrostatic quadrupole field.

Adopting a Cartesian co-ordinate system, the distribution of electrostatic potential V(x,y,z) in an electrostatic quadrupole field can be expressed generally as $$V = \frac{V_o}{r_o^2}(2x^2 - y^2 - z^2). \quad (4)$$

where $r_o$ is a constant and $V_o$ is the applied potential.

A region of the electrostatic quadrupole field can be generated using an electrode structure having rotational symmetry about the longitudinal X-axis, and an electrode structure such as this is preferred because it has a focussing effect on the ions in the Y-Z plane.

Such rotationally symmetric electrode structures will be referred to hereinafter as "three-dimensional" electrode structures, and other electrode structures described herein, which do not have rotational symmetry, will be referred to as "two-dimensional" electrode structures.

An example of a "three-dimensional" electrode structure consists of two electrodes whose shapes conform to the respective equipotential surfaces at the potential $V_o$ and at earth potential. The electrode at the potential $V_o$ would have a hyperboloid surface generated by rotating the hyperbola $2x^2-y^2=r_o^2$ (in the X-Y plane) about the X-axis, and the earthed electrode would have a conical electrode surface, with the apex at the origin, generated by rotating the lines $$x = y/\sqrt{2}$$

(for y>o) and $$x = -y/\sqrt{2}$$

(for y>o) about the X-axis. The potential at different co-ordinate positions between these two electrode surfaces satisfies equation 4 above.

Figure 3A:
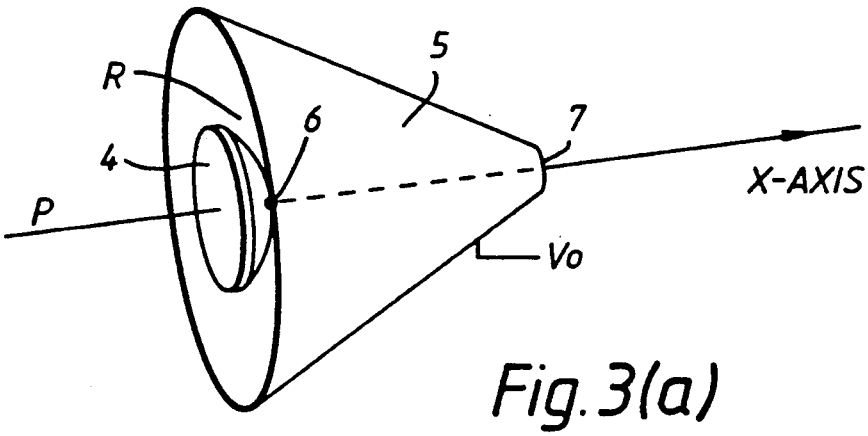
FIGS. 3*a* to 3*f* show alternative forms of electrode structure used to generate the electrostatic retarding field in the ion storage device.
Figure 3B:
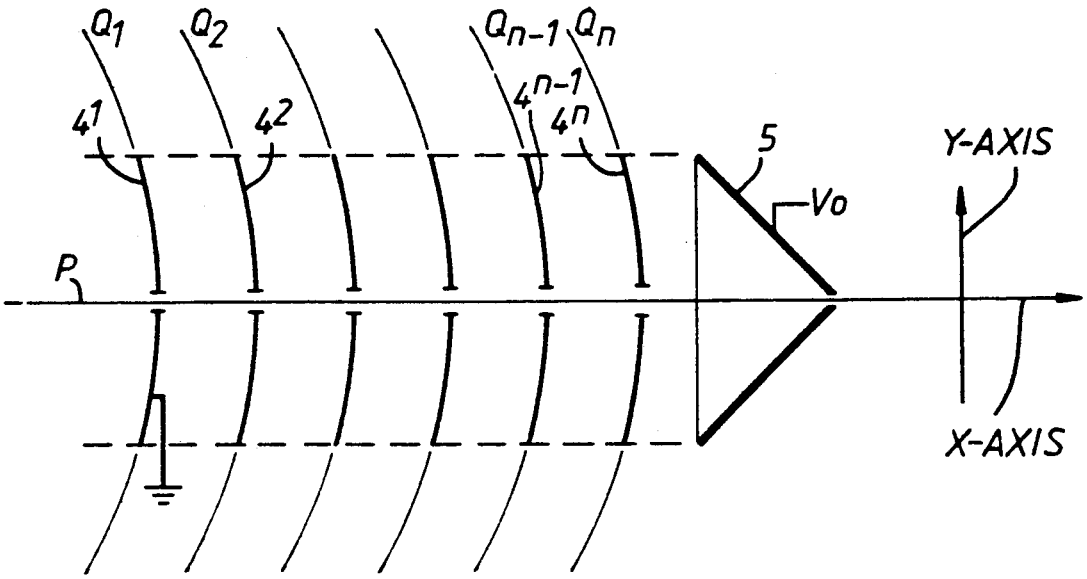
Figure 3C:
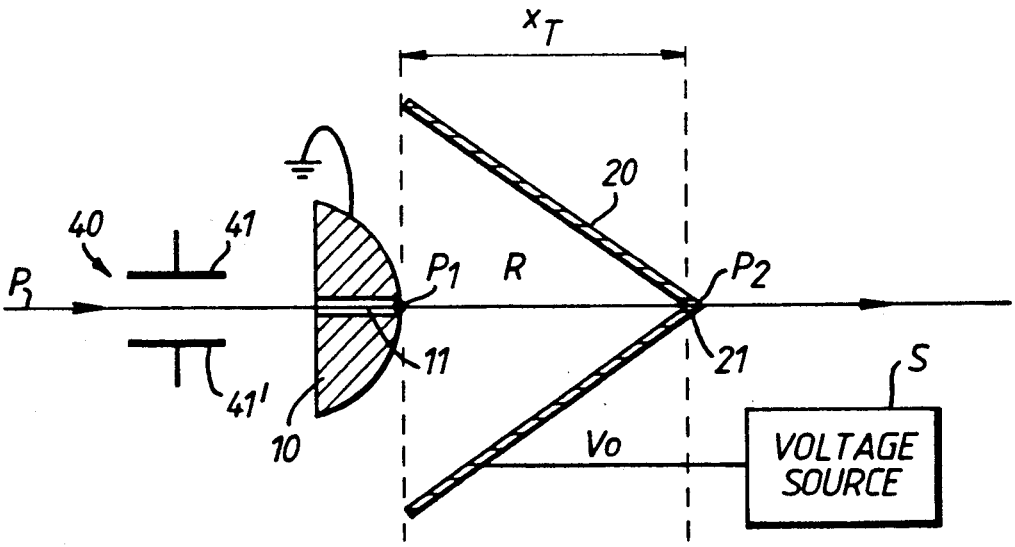
Figure 3D:
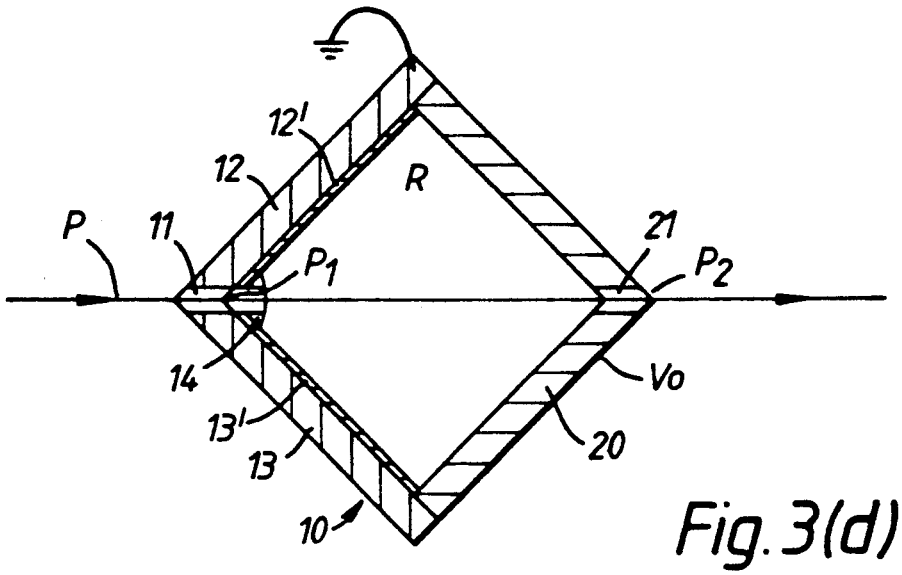
Figure 3E:
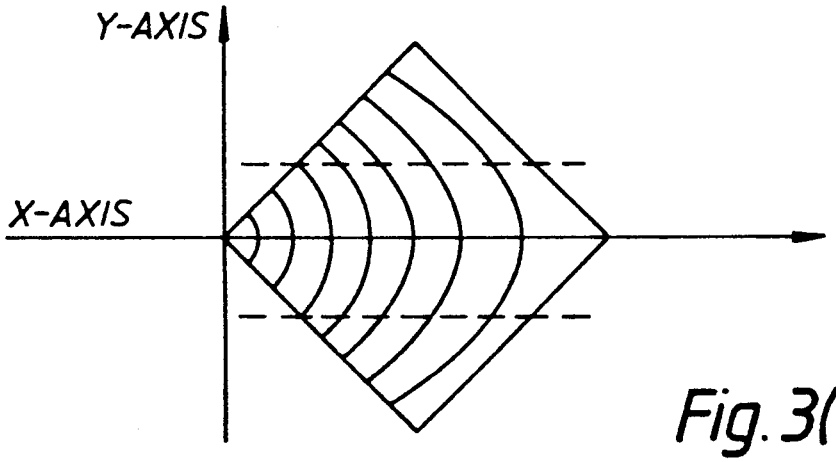
Figure 3F:
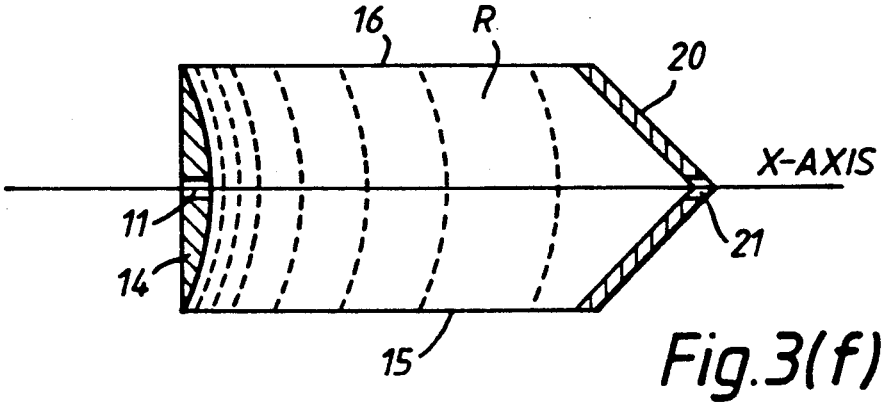

Referring now to FIG. 3a, which shows a "three-dimensional" electrode structure for use in the ion storage device, the potentials on the two electrodes are, in fact, reversed so that the hyperboloid electrode (referenced 4 in FIG. 3a) is at earth potential and the conical electrode (referenced 5) is at the potential $V_o$. Ions enter the device through an entrance aperture 6 in the hyperboloid electrode 4, travel along the X-axis, and exit the device via an exit aperture 7 in the conical electrode 5. If the position x of an ion on the X-axis is defined as the distance of the ion from the exit aperture 7, and the distance between the entrance and exit apertures 6,7, is $x_T$, then it can be shown that the potential at any point x on the X-axis within the ion storage device satisfies equation 2 above, and that the equipotentials in the field region between the opposed electrode surfaces lie on respective hyperboloid surfaces having rotational symmetry about the X-axis.

The entrance and exit apertures 6,7 are located on the X-axis at respective positions corresponding to $P_1$ and $P_2$ in FIG. 2, the latter being the time focal point for ions introduced into the device. During each ion storage period, the downstream electrode 5 will be maintained at the retarding voltage $V_o$ with respect to the upstream electrode 4. To that end, the upstream electrode 4 could be maintained at earth potential and the retarding voltage $V_o$ would be applied to the downstream electrode 5 during each ion storage period. However, in an alternative mode of operation, the downstream electrode could be maintained at the retarding voltage $V_o$ and the voltage on the upstream electrode would be pulsed up to the voltage $V_o$ so as to create a field free region between the electrodes during each listening period.

In practice, the flight path through the ion storage device could be 0.5 m or more in length, and so the two electrodes 4,5 would need to be prohibitively large.

With the aim of reducing the physical size of the ion storage device, the single hyperboloid electrode 4, in the electrode structure of FIG. 3(*a*), is replaced by a plurality of such electrodes $4^1, 4^2 \ldots 4^n$ spaced apart at intervals along the X-axis, as shown in the transverse cross-sectional view of FIG. 3(*b*).

Each hyperboloid electrode lies on a respective equipotential surface ($Q_1, Q_2 \ldots Q_n$) and is maintained at the retarding voltage for that equipotential during each ion storage period. As before, the downstream electrode 5 has a conical electrode surface which is maintained at the retarding voltage $V_o$, and each electrode has a respective aperture, located on the X-axis, enabling the ions to travel through the device. The electrodes $4^1, 4^2 \ldots 4^n$, 5 are dimensioned so as to occupy a cylindrical region of space, bounded by the broken lines shown in FIG. 3(*b*), giving the ion storage device a more compact structure on the transverse Y-Z plane.

A "two-dimensional" electrostatic quadrupole field has a potential distribution which can be defined, in Cartesian co-ordinates, by the equation $$V(x,y) = \frac{V_o}{r_o^2}(x^2 - y^2) \tag{5}$$

and can be generated by electrodes conforming to equipotential surfaces extending parallel to the Z-axis. An electrostatic field of this form has four-fold symmetry about the Z-axis and could be generated by a quadrupole electrode structure (which provides field in all four quadrants about the Z-axis) or a monopole electrode structure (which provides field in only one of the quadrants). The monopole electrode structure could consist of a rod (at potential $V_o$) of hyperbolic section in the X-Y plane, and an earthed electrode of V-shaped section in the X-Y plane. Referring now to FIG. 3(*c*) and in direct analogy to the "three-dimensional" electrode structures shown in FIGS. 3(*a*) and 3(*b*), the voltages on the electrodes are in fact reversed so that the V-section electrode is at the potential $V_o$ and the rod is earthed. Ions enter the ion storage device via an entrance aperture in the hyperbolic rod (at a position corresponding to $P_1$ in FIG. 2) and they exit the device through an exit aperture in the V-shaped electrode (at a position corresponding to $P_2$ in FIG. 2). Again, if the position x of an ion is defined as the distance of the ion from the exit aperture $P_2$, and the distance between the entrance and exit apertures $P_1$,$P_2$ is $x_T$, then the potential at any point x along the X-axis will satisfy equation 2 above.

Referring again to FIG. 3(*c*), the electrode structure comprises two elongate electrodes 10,20 which extend in the Z-axis direction and are spaced apart from each other along path P—the longitudinal X-axis. The electrodes have inwardly facing electrode surfaces arranged symmetrically with respect to the X-Z plane, and these electrode surfaces define the field region R within which the electrostatic retarding field is applied.

Electrode 10 is in the form of a rod having a hyperbolic, or alternatively a circular transverse cross-section, whereas electrode 20 has a substantially V-shaped transverse cross-section, subtending an angle of 90°. Each electrode has a respective aperture 11,21 located at $P_1$ and $P_2$ on path P by which ions can respectively enter and exit the field region R. During each ion storage period, the downstream electrode 20 is maintained, by a suitable voltage source S, at an electrostatic retarding voltage $V_o$ with respect to the upstream electrode 10, the latter being maintained at earth potential in this example.

FIG. 3(*d*) illustrates an alternative form of monopole electrode structure suitable for generating the electrostatic retarding field. In this arrangement, electrode 10 is replaced by a pair of electrically insulating side walls 12,13 made from glass, for example, which are so disposed in relation to electrode 20 as to define a closed structure having a square transverse cross-section. The inside surface of each side wall 12,13 bears a layer 12',13' of a material having a high electrical resistivity, and electrode 20 is maintained at said retarding voltage $V_o$ with respect to an electrode 14, again of hyperbolic or circular transverse cross-section, at the apex formed by the side walls 12,13. As before, the upstream electrode 10 in FIGS. 3(*c*) and 3(*d*) could be pulsed up to the voltage $V_o$ during each listening period.

The quadrupole electrostatic field created by the electrode structures shown in FIGS. 3(*c*) and 3(*d*) is defined by hyperbolic equipotential lines in the transverse X-Y plane, as illustrated in FIG. 3(*e*), and the equipotentials lie on respective surfaces extending parallel to the Z-axis direction. Voltage V(x,y) varies linearly along the electrically insulating side walls 12,13 shown in FIG. 3(*d*), from the voltage value (e.g. earth potential) at electrode 14 to that at electrode 20 and, in view of this, the layers 12',13' of electrically resistive material applied to the side walls 12,13 should ideally be of uniform thickness. However, such layers may be difficult to deposit in practice.

In an alternative embodiment, the layers 12',13' are replaced by discrete electrodes provided on the side walls along the lines of intersection with selected equipotentials in the electrostatic field.

Each such electrode is maintained at a respective voltage intermediate that at electrode 14 and that at electrode 20. Since the voltage must vary linearly along each side wall 12,13, the discrete electrodes provided thereon lie on parallel, equally-spaced lines and the required voltages can then be generated by connecting the discrete electrodes together in series between the electrodes 14 and 20 by means of resistors having equal resistance values. This structure may also have end walls, and discrete electrodes, conforming to respective hyperbolic equipotential lines, could be provided on these walls also.

FIG. 3(*f*) shows a transverse cross-sectional view through another "two-dimensional" monopole electrode structure which is analogous to the "three-dimensional" structure described with reference to FIGS. 3(*b*). In this case, the discrete electrodes lie in parallel planes defining sides 15,16 of the structure, and this gives a more compact structure in the transverse (Y-axis) direction. As illustrated diagramatically in FIG. 3(*e*), the electrostatic potential varies in non-linear fashion along each side 15,16 of the structure, and so the discrete electrodes are spaced progressively closer together in the direction approaching electrode 14. As before, discrete electrodes may also be provided at the ends of the structure, and each such electrode would conform to a respective hyperbolic equipotential line having the form shown in FIG. 3(*e*).

In the case of the embodiments shown in FIGS. 3(*d*) and 3(*f*), it would be possible to use a series of apertured electrode plates, each having a hyperbolic transverse cross-section and extending parallel to the Z-axis direction, in place of the discrete electrodes arranged along the sides of the electrode structures, and "three-dimensional" versions of these structures would also be feasible.

Since ions do not undergo any electrostatic retardation during the listening period, ions should not enter the defined region R during that period. Accordingly, an electrostatic deflection arrangement 40 comprising a pair of electrode plates 41,41', disposed to either side of path P, is provided. The electrode plates are energised during each listening period so as to deflect ions away from path P and prevent them from entering region R. To reduce the effect of fringing fields at the entrance aperture 12, the deflection arrangement 40 is preferably energised a short time before the retarding field is removed from electrode 20.

In order that a sufficient number of ions may enter region R, it is desirable that each ion-storage period should be of sufficient duration to allow ions having the smallest mass-to-charge ratio of interest $r_s$ $(m/q)_s$ to travel a maximum distance d into region R. For a typical application the distance d might be about 0.7 $x_T$.

It can be shown that the time $t_s$ required for such ions to travel said distance d during an ion-storage period (when the electrostatic retarding field is being applied) is given by the expression $$t_s = (K^{\frac{1}{2}})\ln\left(1 - \frac{d}{x_T}\right)$$

where $$K = \frac{r_s x_T^2}{2V_o}$$

The listening period should also be of sufficient duration to enable ions having the largest mass-to-charge ratio of interest $r_l$ $(m/q)_l$ to exit the defined region R. Since a heavy ion may only just have entered region R at the moment when the field generator is de-energised, the listening period should be long enough to allow that ion to traverse region R, a distance $x_T$.

Applying equation 1, the velocity of a heavy ion on entry into region R would be $$\left(\frac{2V_o}{r_l}\right)^{-\frac{1}{2}}$$

and so the minimum listening period $t_l$ would need to be $$t_l = x_T\left(\frac{2V_o}{r_l}\right)^{-\frac{1}{2}}$$

Accordingly, the ratio of the ion-storage period to the listening period should ideally be $$\left(\frac{r_s}{r_l}\right)^{\frac{1}{2}}\ln\left(1 - \frac{d}{x_T}\right)$$

Thus, if d is chosen to be 0.7 $x_T$ and the mass ratio of the heaviest to the lightest ions is 10, the duty cycle would be 27.5%; that is to say, 27.5% of total number of ions in the ion beam would be available for subsequent analysis. Similarly, if the mass ratio is 100, the duty cycle would be 10.7%. The duty cycles attainable by the ion storage device of this invention represent a significant improvement over hitherto known ion storage devices employing continuous ion beams and time-of-flight mass spectrometry systems incorporating the ion storage device can attain relatively high sensitivities.

If desired, the duration of the ion-storage period may be set to discriminate in favour of detecting ions having particular mass-to-charge ratios. If, for example, it is desired to detect relatively heavy ions in preference to lighter ions, the ion storage period would be of relatively long duration.

As has been explained, ions which are of interest need not in practice travel the maximum distance $x_T$ while the electrostatic retarding field is being applied during each ion storage period, and typically such ions might only travel a distance of about 0.7 $x_T$.

Accordingly, the electrostatic retarding field need not be applied over a corresponding downstream section of the defined region R, and so the downstream electrode 5 and one or more of the downstream hyperboloid electrodes (e.g. $4^n$, $4^{n-1}$) could be omitted from the electrode structure shown in FIG. 3(*b*).

Ions entering the ion storage device will still be brought to a time focus at the position on path P that would have been occupied by the exit aperture in electrode 5, corresponding to the position $P_2$ in FIG. 2; however, the ions will exit the electrode structure at a position upstream of the time focal point via the aperture in the hyperboloid electrode at the downstream end of the electrode structure.

In similar fashion, it would be possible to omit the V-section electrode and, optionally, one or more of the discrete downstream electrodes from the "two-dimensional" electrode structures described with reference to FIGS. 3(*d*) to 3(*f*). In this case, the end electrode in the structure would be a hyperboloid section plate corresponding to a respective equipotential surface.

An ion-storage device, as described, is particularly advantageous in that the stored ions are relatively free from space-charge effects and do not suffer any delay due to 'turn-around' time. A further advantage results from the fact that ions are not timed through any source extraction or focussing optics.

Also, an ion-storage device as described may employ any form of ion lens and ion source, including high pressure sources. However, for any given mass-to-charge ratio the ions entering the defined region should preferably (though not necessarily) all have the same energy. Accordingly, the device may attain a higher mass resolving power if the associated ion source produces ions having a relatively small spread of energies. Ion sources for which the energy spread is usually quite small (~0.5 eV) include electron impact sources and thermospray sources, commonly used in liquid and gas chromatography mass spectrometry.

Furthermore, because the ion storage device has a relatively high duty cycle, the device is well suited to the analysis of small sample volumes (such as biological and biochemical samples, for example) which may be delivered over a relatively short time scale using conventional inlet systems, such as a liquid chromatograph for example.

It will be understood that an ion storage device as described, has general utility in applications requiring both the storage and spatial time focussing of ions having different mass-to-charge ratios.

In a particular application, the ion storage device may constitute the flight path of a time-of-flight mass spectrometer, ions having different mass-to-charge ratios exiting the defined region being detected separately at different times using a suitable detector.

I claim:

1. An ion-storage device for storing ions moving along a path, comprising field generating means for subjecting ions to an electrostatic retarding field during an initial part only of a preset time interval, the electrostatic retarding field having a spatial variation such that ions which have the same mass-to-charge ratio and enter the ion storage device during said initial part of the pre-set time interval are all brought to a time focus during the remaining part of that time interval.

2. An ion storage device as claimed in claim 1, wherein the spatial variation of the electrostatic retarding field is such that the velocity of an ion during said initial part of the preset time interval is related linearly to its separation along the path from the point at which the ion is brought to a time focus.

3. An ion-storage device as claimed in claim 1, wherein the electrostatic retarding field is an electrostatic quadrupole field.

4. A mass spectrometry system as claimed in claim 3, wherein the field generating means comprises an electrode structure having rotational symmetry about the longitudinal axis of the ion storage device.

5. A mass spectrometry system as claimed in claim 4, wherein the electrode structure comprises a first electrode having a spherical or hyperboloid electrode surface and a second electrode having a conical electrode surface facing the electrode surface of the first electrode, wherein the second electrode is maintained at a retarding voltage with respect to the first electrode during said initial part of the or each preset time interval and has an exit aperture by which ions can exit the ion storage device, and the first electrode has an entrance aperture by which the ions can enter the ion storage device.

6. A mass spectrometry system as claimed in claim 5, wherein the retarding voltage is such that the ions are brought to said time focus at the exit aperture of the second electrode.

7. A mass spectrometry system as claimed in claim 4, wherein the electrode structure comprises a plurality of electrodes spaced at intervals along the longitudinal axis of the ion storage device, each electrode in the plurality substantially conforming to a respective equipotential surface in the electrostatic quadrupole field and being maintained at a respective relative retarding voltage during the initial part of the or each said preset time interval, and having a respective aperture for enabling the ions to travel through the ion storage device.

8. A mass spectrometry system as claimed in claim 7, wherein the electrode structure comprises a further electrode having a conical electrode surface, the further electrode having an exit aperture by which ions can exit the ion storage device and being maintained at a relative retarding voltage during the initial part of the or each said preset time interval.

9. A mass spectrometry system as claimed in claim 8, wherein the respective retarding voltages on the electrodes are such that the ions are brought to a time focus at the exit aperture of the further electrode.

10. An ion-storage device as claimed in claim 3, wherein the field generating means has a monopole electrode structure comprising a first electrode having an electrode surface of substantially V-shaped transverse cross-section and a second electrode having an electrode surface of curvilinear transverse cross-section facing the electrode surface of the first electrode, wherein the first electrode is maintained in operation at a retarding voltage relative to the second electrode and has an aperture whereby ions can exit the device, and the second electrode has an aperture whereby ions can enter the device.

11. An ion storage device as claimed in claim 3, wherein the field generating means has a monopole electrode structure comprising an electrically conductive member having a substantially V-shaped transverse cross-section and an electrically resistive member having a substantially V-shaped transverse cross-section, wherein the electrically conductive and the electrically resistive members define a closed structure bounding a defined region and the electrically conductive member is maintained, in operation, at a retarding voltage relative to the apex of the electrically resistive member and the members have respective apertures by which ions can enter and exit the defined region.

12. An ion storage device as claimed in claim 10, wherein the monopole electrode structure has a plurality of additional electrodes disposed at the sides and/or ends of the structure, wherein each additional electrode extends along a respective line of intersection with a selected equipotential in the electrostatic quadrupole field and is maintained at a respective retarding voltage.

13. An ion storage device as claimed in claim 12, wherein the sides are parallel.

14. An ion-storage device as claimed in claim 1, wherein ions are subjected to the electrostatic retarding field during successive said time intervals.

15. An ion-storage device as claimed in claim 1, including means operative during the remaining part of the or each said preset time interval to prevent ions entering the device during that or those periods.

16. An ion-storage device as claimed in claim 1, wherein the ratio of the initial part of the preset time interval to the remaining part of the preset time interval is proportional to $$\left(\frac{r_s}{r_l}\right)^{\frac{1}{2}}$$

wherein $r_s$ is the smallest mass-to-charge ratio to be detected, and $r_l$ is the largest mass-to-charge ratio to be detected.

17. A time-of-flight mass spectrometer comprising an ion source for generating ions which move along a path, an ion storage device and means for detecting ions which exit the ion storage device, wherein the ion storage device comprises field generating means for subjecting ions to an electrostatic retarding field during an initial part only of a preset time interval, the electrostatic retarding field having a spatial variation such that ions which have the same mass-to-charge ratio and enter the ion storage device during said initial part of the pre-set time interval are all brought to a time focus during the remaining part of that time interval.

* * * * *